US006747214B2

(12) United States Patent
Goeblmaier et al.

(10) Patent No.: US 6,747,214 B2
(45) Date of Patent: Jun. 8, 2004

(54) INSULATED ELECTRICAL CONDUCTOR WITH PRESERVED FUNCTIONALITY IN CASE OF FIRE

(75) Inventors: Reinhold Goeblmaier, Fuerth (DE); Ferdinand Groegl, Nuremberg (DE)

(73) Assignee: Nexans, Paris (FR)

( * ) Notice: Subject to any disclaimer, the term of this patent is extended or adjusted under 35 U.S.C. 154(b) by 0 days.

(21) Appl. No.: 09/981,713

(22) Filed: Oct. 19, 2001

(65) Prior Publication Data

US 2002/0046871 A1 Apr. 25, 2002

(30) Foreign Application Priority Data

Oct. 20, 2000 (DE) ..... 100 51 962

(51) Int. Cl.[7] ..... H01B 7/00

(52) U.S. Cl. ..... 174/110 R; 174/36; 174/120 R; 174/121 R; 174/121 A

(58) Field of Search ..... 174/110 R, 110 SR, 174/113 R, 120 R, 120 SR, 121 R, 121 A, 122 SR, 36

(56) References Cited

U.S. PATENT DOCUMENTS

| | | | | | |
|---|---|---|---|---|---|
| 2,222,555 | A | * | 11/1940 | Robinson et al. | 174/121 R |
| 3,425,865 | A | * | 2/1969 | Shelton, Jr. | 428/384 |
| 3,823,255 | A | * | 7/1974 | La Gase et al. | 174/113 R |
| 4,284,842 | A | * | 8/1981 | Arroyo et al. | 174/107 |
| 4,319,940 | A | * | 3/1982 | Arroyo et al. | 156/56 |
| 4,472,468 | A | * | 9/1984 | Tailor et al. | 428/57 |
| 4,510,348 | A | * | 4/1985 | Arroyo et al. | 174/121 A |
| 4,514,466 | A | * | 4/1985 | Leon et al. | 428/383 |
| 4,715,915 | A | * | 12/1987 | Vanderzee | 156/182 |

FOREIGN PATENT DOCUMENTS

| | | | | |
|---|---|---|---|---|
| EP | 0 040 035 | A | * 11/1981 | H01B/7/02 |
| EP | 0 100 829 | A | 2/1984 | |
| FR | 2 573 910 | A | 5/1986 | |
| JP | 54 131791 | A | 10/1979 | |
| JP | 05 325655 | A | 12/1993 | |
| JP | 08 287737 | A | 11/1996 | |

* cited by examiner

*Primary Examiner*—William H. Mayo, III
(74) *Attorney, Agent, or Firm*—Sughrue Mion, PLLC

(57) ABSTRACT

An insulated electrical conductor with preserved functionality in case of fire includes a metallic conductor, a first glass and/or mica containing layer, which is applied to the conductor, and a second plastic layer sheathing the first layer. The first layer consists of at least two longitudinally introduced strips of glass and/or mica applied to the conductor, the width of which is selected such that each of the strips overlaps itself by at least 50%.

8 Claims, 3 Drawing Sheets

INSULATED ELECTRICAL CONDUCTOR WITH PRESERVED FUNCTIONALITY IN CASE OF FIRE

This application is based on and claims the benefit of German Patent Application No. 10051962.8 filed Oct. 20, 2000, which is incorporated by reference herein.

BACKGROUND OF THE INVENTION

The present invention relates to an insulated electrical conductor which will continue to function in case of fire, an electrical cable incorporating such a conductor, and a process for producing an insulated electrical conductor and an electrical cable.

When cables are exposed to flames, the insulation and sheath materials that are present in the cable usually burn, unless these materials have already completely or partially melted away due to the heat of the fire. Any residues remaining on the conductors after the fire, unless they have become conductive through carbonization or through the action of extinguishing agents, may prevent a short circuit between the conductors or a ground fault and thus permit emergency operation at low operating voltages. As a rule, however, these residues are unable to withstand mechanical loads, so that even the slightest movements, such as thermally induced changes in the length of the conductors during cooling after the fire, or slight vibrations cause the residues to be destroyed and the cable to fail. Cables that must remain operational in case of fire, for instance cables for emergency call systems or for the operation of fire extinguishing systems, are insulated with materials that are stable in a fire. Additionally inserted mineral layers—such as continuous glass filament strips—can maintain the insulating properties in a fire. Here, too, however, the insulation capacity may be significantly affected by extinguishing agents.

The greatest safety with respect to operability in case of fire is achieved with mineral-insulated cables. These cables are insulated with a solid ceramic mass and enclosed with a sheath of metal. Such cables are extremely expensive, however, and have little flexibility.

U.S. Pat. No. 3,425,865 discloses an insulated conductor in which a first coating of an inorganic barrier material is applied to the conductor. This is a strip of glass fabric reinforced with mica. The mica particles are bonded to the glass fabric strip by means of a silicon resin. The layer may be applied to the conductor by extrusion, in the form of a tape, or in some other manner. In addition, a second abrasion resistant polyimide layer is placed over the first layer. Additional insulation layers may be applied to this polyimide layer. An insulated conductor produced in this manner is distinguished by its low weight, high abrasion resistance, and high flame resistance.

DE Utility Model 87 16 166 discloses a heat resistant electrical cable having a nickel-coated copper conductor, which is sheathed by at least one layer of mica tape and a glass filament braid placed on top of this layer. A metal strip wound with overlaps is applied on top of the glass filament braid and a braid made of metal wires on top thereof. Such a construction is very costly and at best marketable for special applications. The cable furthermore has little flexibility and is very heavy due to the high metal content.

SUMMARY OF THE INVENTION

The object of the present invention is to provide an insulated electrical conductor which is flexible, has little weight and can be produced cost-effectively.

This object is attained by an insulated electrical conductor comprising a metallic conductor, a first glass and/or mica containing layer applied to the conductor, and a second plastic layer sheathing the first layer, characterized in that the first layer is made of at least two longitudinally introduced strips (2, 3) of glass and/or mica, which are applied to the conductor, wherein the width of said strips (2, 3) is selected such that the strips (2, 3) overlap each other by at least 50%.

The object of the invention is further attained by a cable including at least two conductors of the type described above.

The essential advantage of the invention is that the longitudinal introduction of, e.g., two mica containing strips and the required overlap actually produces three mica layers on the conductor. If a winding with a thread or strip of a high tensile, flame resistant material is provided, the two strips are held together during production as well as in case of fire.

Other advantages of the invention will be apparent from the description and claims below.

DETAILED DESCRIPTION OF THE INVENTION

Figure 1:
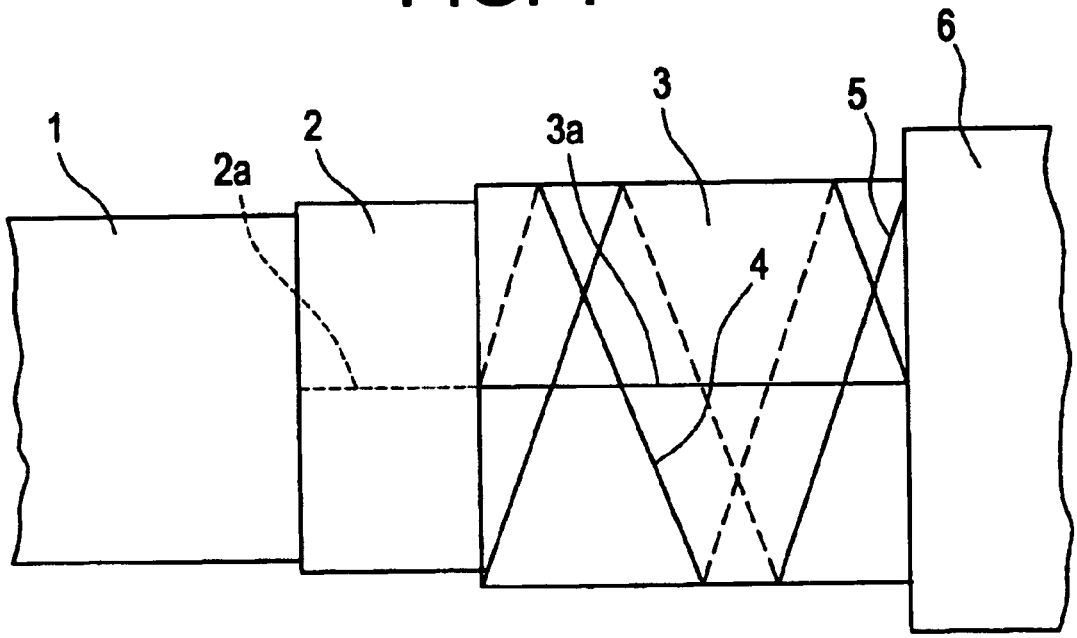
FIG. 1 shows an insulated conductor according to the teaching of the invention.
Figure 4:
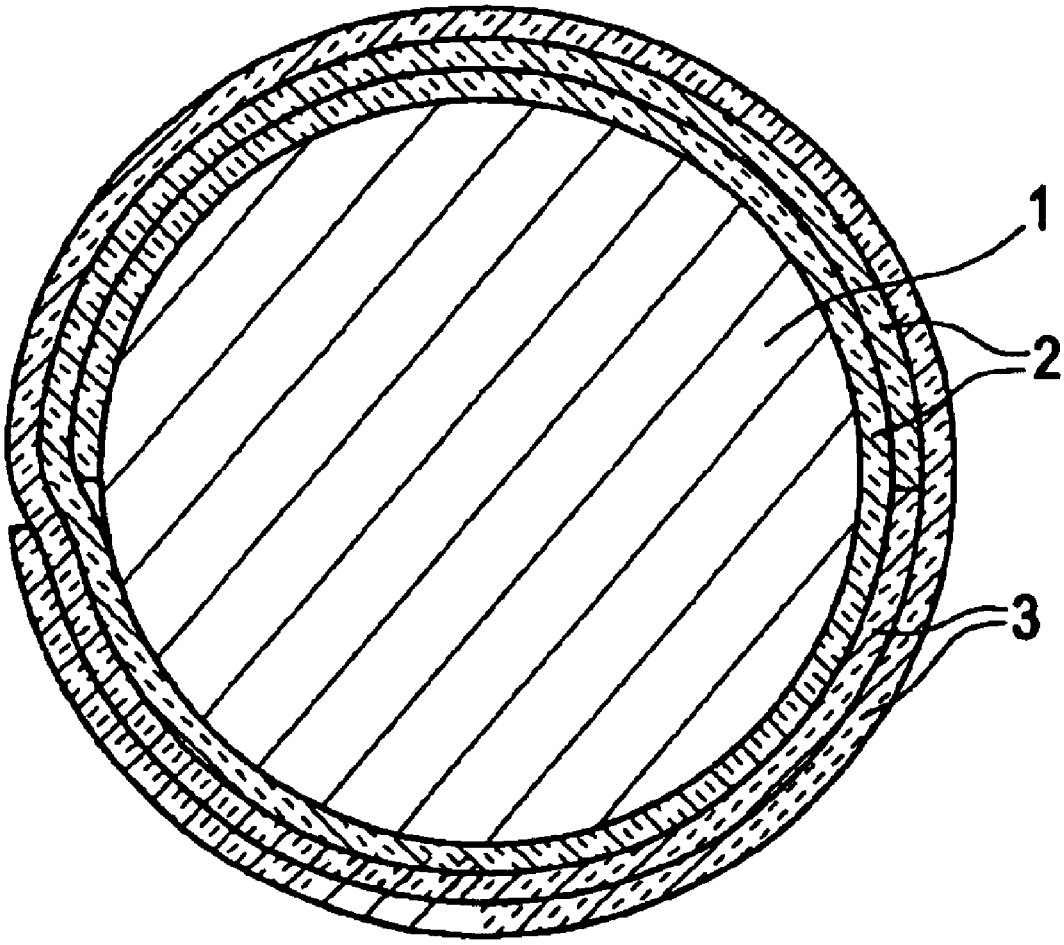
FIG. 4 is a cross-section of FIG. 1.

FIG. 1 shows an insulated conductor according to the teaching of the invention—in staggered view—with a metallic conductor 1, which is solid or consists of individual wires and is preferably made of copper. Conductor 1 or the individual wires of the conductor may be tin-plated. Over conductor 1, a first layer 2 of a glass filament/mica strip is provided, which is longitudinally introduced and applied to conductor 1 with an at least 50% overlap. The glass filament/mica strip consists of a glass filament fabric to which mica particles are bonded with a silicon resin. The next layer 3 also forms a glass filament/mica strip introduced longitudinally with an at least 50% overlap. The overlap seam 2*a* of the first layer 2 is offset by 180° in relation to the overlap seam 3*a* of the second layer 3. The first layer 2 is applied to conductor 1 in such a way that the mica layer is facing the conductor surface. Two threads 4 and 5 are wound crosswise onto the second layer 3. Threads 4 and 5 are preferably glass or carbon fibers. An extruded insulation layer 6 forms the outer sheath of the insulated conductor. FIG. 4 illustrates a cross-section of the insulated conductor. The insulating layer 6 maybe made of an inexpensive plastic, e.g. polyethylene. Said polyethylene, however, should be made flame resistant by means of known additives to prevent flames from spreading in case of fire.

Due to the more than 50% overlap of layers 2 and 3, an at least triple mica layer is obtained, so that the flame resistance of the conductor is clearly increased. Threads 4 and 5 ensure that layers 2 and 3 maintain their closed position around conductor 1 during production as well as in case of fire after the insulation 6 has been destroyed, so that the mica platelets surround and insulate conductor 1 even during and after a fire. The glass components in layers 2, 3 and possibly 4 and 5 start to melt at a temperature above 1000° C. and together with the mica platelets form an effective insulation at high temperatures.

Figure 2:
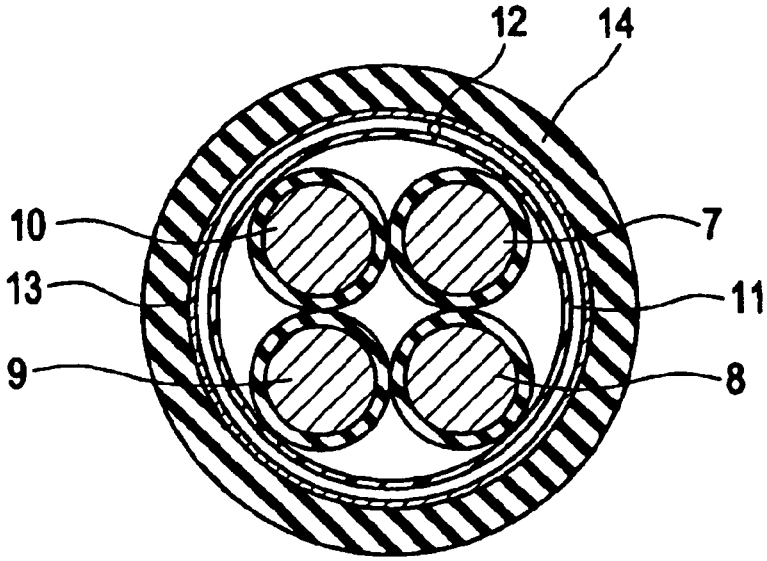
FIG. 2 shows a section through a cable according to the invention.

FIG. 2 shows a section through a conductor with preserved functionality in case of fire consisting of four insulated wires 7, 8, 9 and 10, which are stranded together and are surrounded by a first layer 11 of a coated glass filament strip. The coating of the glass filament strip consists of an uncured, flame resistant, halogen-free ethylene copolymer compound. Layer 11 is intended to act as a flame barrier layer. A tin-plated preferably helically extending sheath wire 12 is placed over layer 11. A second layer 13 of a metal strip, plastic coated on one side, is longitudinally introduced on top thereof with overlapping strip edges. The bare metal layer contacts the sheath wire 12. This second layer 13 serves as a shield. An outer sheath 14 surrounds the shielding layer 13. Each wire is constructed like the insulated wire shown in FIG. 1. The outer sheath 11 is advantageously made of a plastic that has been rendered flame resistant, e.g. highly filled polyethylene.

Figure 3:
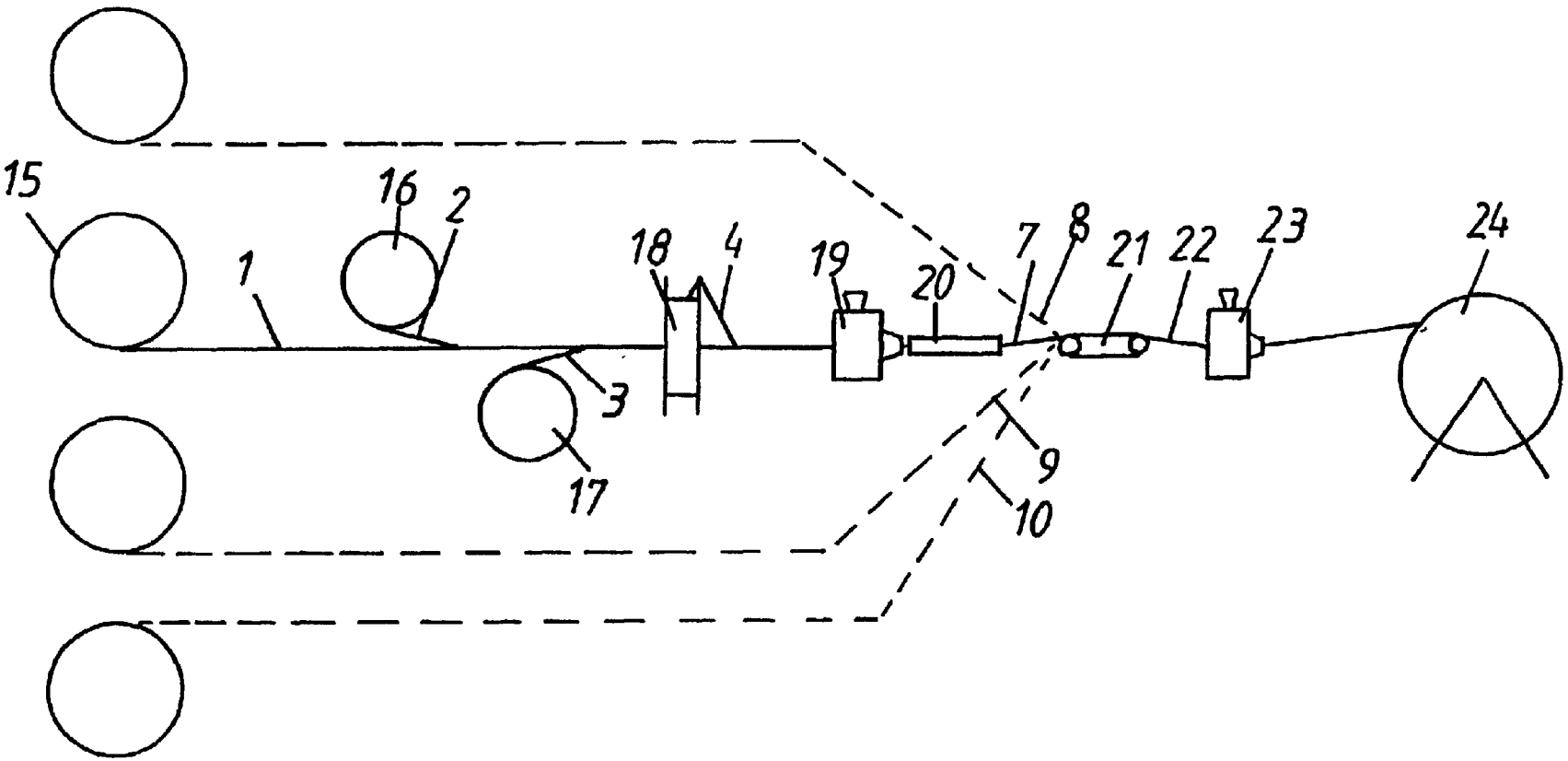
FIG. 3 is a schematic representation of a production process for a cable as depicted in FIG. 2.

FIG. 3 is a schematic representation of a production process for a cable as depicted in FIG. 2.

The metallic conductor 1 is pulled from a supply reel or a supply container 15 and is first sheathed by a longitudinally introduced glass filament/mica strip forming the first layer 2. The surface of the glass filament/mica strip carrying the mica layer faces the conductor surface. The width of the glass filament/mica strip is dimensioned to be at least 1.5 times the circumference of the conductor 1. The glass filament/mica strip pulled off from the supply reel 16 is formed by a tube (not depicted), which is arranged coaxially to the passing conductor 1. The glass filament/mica strip pulled from a supply reel 17 and forming the second layer 3 is likewise placed around the first layer 2.

The second layer 3 is placed on top of the first layer 2 such that the overlaps lie diametrically opposite each other. Layers 2 and 3 thus form a three-ply mica-containing layer.

Two glass or carbon fibers 4 and 5 are then applied to the second layer 3 with an opposite direction of lay. For clarity's sake, only one winder 18 and one thread 4 are depicted. The conductor thus pre-insulated is then fed to an extruder 19, which applies the insulating layer 6 to the pre-insulated conductor. Said insulating layer 6 is cooled in a cooling basin 20. In the above-described manner, four insulated wires 7, 8, 9 and 10 are simultaneously produced in similar production units arranged side by side. The insulated wires 7, 8, 9 and 10 are jointly fed to an SZ strander 21 where they are stranded together with an alternating direction of lay. The strand composite 22 is provided with an outer sheath 14 in an extruder 23, and the finished cable is wound onto a supply reel 24. The means for applying glass filament strip 11, sheath wire 12, and sheath 13 are not depicted for the sake of clarity. Such means are known in cabling and line technology.

Extruder 19 may also be an extruder with four nozzles. In this embodiment, the conductors 1 provided with the first layer 2, the second layer 3, and threads 4 and 5 are simultaneously coated with insulation material 6 and stranded after having passed through cooling basin 20.

The described process is an optimal solution with respect to production costs for the production of the cable depicted in FIG. 2.

What is claimed is:

1. An insulated electrical conductor with preserved functionality in case of fire, comprising:

a metallic conductor, a first layer applied to said conductor, and a second plastic layer sheathing the first layer, wherein the first layer is made of at least two longitudinally introduced tapes containing at least one of glass and mica, which are applied to the conductor, wherein the width of said longitudinally introduced tapes is selected such that each of the at least two longitudinally introduced tapes overlaps itself by at least 50%, and wherein at least one tape or thread of a high-tensile, flame resistant material is helically applied to the first layer and wherein, with the use of said two longitudinally introduced tapes, an overlap area of a first of said two rapes is offset by 180° in relation to an overlap area of a second tape of said two longitudinally introduced tapes.

2. A conductor as claimed in claim 1, wherein the longitudinally introduced tapes are made of a glass filament tape with mica particles, said mica particles being bonded to the glass filament tape with a silicon resin.

3. A conductor as claimed in claim 1, wherein said second layer comprises two tapes or threads with a high tensile, flame resistant material that are wound onto the first layer with an opposite direction of lay.

4. A conductor as claimed in claim 1, wherein the thread of high-tensile flame resistant material is a glass filament or carbon fiber thread.

5. A conductor as claimed in claim 1, characterized in that the at least two longitudinally introduced tapes of the first layer are glass/mica strips, and the mica layer faces the conductor.

6. An electrical cable with preserved functionality in case of fire, characterized in that said cable comprises at least two stranded conductors as claimed in claim 1.

7. A conductor as claimed in claim 1, wherein said at least two longitudinally introduced tapes comprises only two tapes, and said two tapes overlap themselves so as to attain three layers around said conductor.

8. An insulated electrical conductor with preserved functionality in case of fire, comprising:

a metallic conductor, a first layer applied to said conductor, and a second plastic layer sheathing the first layer, wherein the first layer is made of at least two longitudinally introduced tapes containing at least one of glass and mica, which are applied to the conductor, wherein the width of said longitudinally introduced tapes is selected such that each of the at least two longitudinally introduced tapes overlaps itself by at least 50%, and wherein at least one tape or thread of a high-tensile, flame resistant material is helically applied to the first layer, and wherein said at least two longitudinally introduced tapes are in direct contact with each other.

* * * * *